US008075262B2

(12) United States Patent
Watanabe et al.

(10) Patent No.: US 8,075,262 B2
(45) Date of Patent: Dec. 13, 2011

(54) CENTRIFUGAL TYPE BLOWER

(75) Inventors: Chie Watanabe, Kariya (JP); Hideki Seki, Nagoya (JP)

(73) Assignee: Denso Corporation, Kariya (JP)

( * ) Notice: Subject to any disclaimer, the term of this patent is extended or adjusted under 35 U.S.C. 154(b) by 386 days.

(21) Appl. No.: 12/460,316

(22) Filed: Jul. 16, 2009

(65) Prior Publication Data

US 2010/0014965 A1 Jan. 21, 2010

(30) Foreign Application Priority Data

Jul. 18, 2008 (JP) ..... 2008-187166

(51) Int. Cl.
*F04D 29/42* (2006.01)

(52) U.S. Cl. ..... 415/204; 415/206; 415/207; 415/212.1; 415/119

(58) Field of Classification Search ..... 415/119, 415/203, 204, 206, 207, 212.1
See application file for complete search history.

(56) References Cited

U.S. PATENT DOCUMENTS 2,926,839 A * 3/1960 Hutt ..... 415/180
5,141,397 A * 8/1992 Sullivan ..... 415/206
6,821,088 B2 * 11/2004 Sakai et al. ..... 415/204
7,186,080 B2 * 3/2007 Smiley et al. ..... 415/205
2002/0131861 A1 9/2002 Sakai et al.
2007/0212218 A1 9/2007 Seki et al.

FOREIGN PATENT DOCUMENTS

JP 9-242697 9/1997
JP 2002-339899 11/2002
JP 2007-239538 9/2007

OTHER PUBLICATIONS

Office action dated Apr. 20, 2010 in corresponding Japanese Application No. 2008-187166.

* cited by examiner

*Primary Examiner* — Edward Look
*Assistant Examiner* — Liam McDowell
(74) *Attorney, Agent, or Firm* — Harness, Dickey & Pierce, PLC

(57) ABSTRACT

A centrifugal-type blower includes a shaft, a fan, and a casing. The casing includes an inlet, an air passage, and a side wall part. A first distance from a center of the fan to the wall part at an inlet side end portion in a radial direction of the fan gradually increases from a volute start part to a volute end part. A second distance from the center to the wall part at any position thereof from an intermediate position to a counter-inlet side end portion in the radial direction is larger than the first distance within a first range. The second distance gradually decreases from the volute start part to a predetermined position. The second distance has the same length as the first distance within a second range.

5 Claims, 8 Drawing Sheets

CENTRIFUGAL TYPE BLOWER

CROSS REFERENCE TO RELATED APPLICATION

This application is based on and incorporates herein by reference Japanese Patent Application No. 2008-187166 filed on Jul. 18, 2008.

BACKGROUND OF THE INVENTION

1. Field of the Invention

The present invention relates to a centrifugal type blower having a centrifugal multiblade fan, and is effectively applied to a blower in an air conditioning system for a vehicle.

2. Description of Related Art

A centrifugal type blower which limits upsizing of a casing and seeks to reduce a noise which is generated as a result of the impingement of air blown out of a fan against a nose part is disclosed in JP-A-2002-339899 (corresponding to US2002/0131861A1).

This centrifugal type blower accommodates a fan and includes a casing having an inlet for air on one end side of a rotatable shaft in its axial direction and having an involuted air passage along an outer circumference of the fan. This casing is formed such that a size of the casing from an outer edge of the fan to a side wall part of the casing on the inlet side is smaller than a size of the casing from the outer edge to the side wall part on the counter-inlet side within a predetermined range from the nose part toward a volute end side of the casing.

Accordingly, since a range which satisfies such a dimensional relationship is set only in the predetermined range, a good balance is achieved between reduction in the noise which is generated as a result of the impingement of air blown out of the fan against the nose part with the upsizing of the casing limited, and inhibition of decrease in an amount of air blown caused by making large the size of the casing from the outer edge of the fan to the side wall part of the casing at the nose part, in comparison with the whole region from a volute start to a volute end of the casing.

Nevertheless, further reduction in the noise which is generated as a result of the impingement of air blown out of the fan against the nose part with the upsizing of the casing limited, is required for such a centrifugal type blower.

SUMMARY OF THE INVENTION

The present invention addresses the above disadvantages. Thus, it is an objective of the present invention to further reduce a noise which is generated as a result of impingement of air blown out of a fan against a nose part with upsizing of a casing limited.

To achieve the objective of the present invention, there is provided a centrifugal-type blower including a rotatable shaft, a centrifugal-type multiblade fan, and a casing. The centrifugal-type multiblade fan has a plurality of blades around the rotatable shaft. The casing has an involuted shape and accommodates the fan. The casing includes a volute start part and a volute end part of the involuted shape, an inlet for air on one end side of the casing in an axial direction of the rotatable shaft, an air passage on an outer circumferential side of the fan, and a side wall part radially outward of the fan. The side wall part, the fan, the volute start part, and the volute end part define the air passage. The side wall part includes an inlet side end portion on a side of the inlet, a counter-inlet side end portion on an opposite side from the inlet, and an intermediate position between the inlet side end portion and the counter-inlet side end portion in the axial direction of the rotatable shaft. A first distance from a center of the fan to the side wall part at the inlet side end portion thereof in a radial direction of the fan gradually increases from the volute start part to the volute end part in a rotational direction of the fan. A second distance from the center to the side wall part at any position thereof from the intermediate position to the counter-inlet side end portion in the radial direction of the fan is larger than the first distance within a first range from the volute start part to a predetermined position, which is located halfway from the volute start part to the volute end part, in the rotational direction of the fan except the predetermined position. The second distance gradually decreases from the volute start part to the predetermined position. The second distance has the same length as the first distance within a second range from the predetermined position to the volute end part in the rotational direction of the fan.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
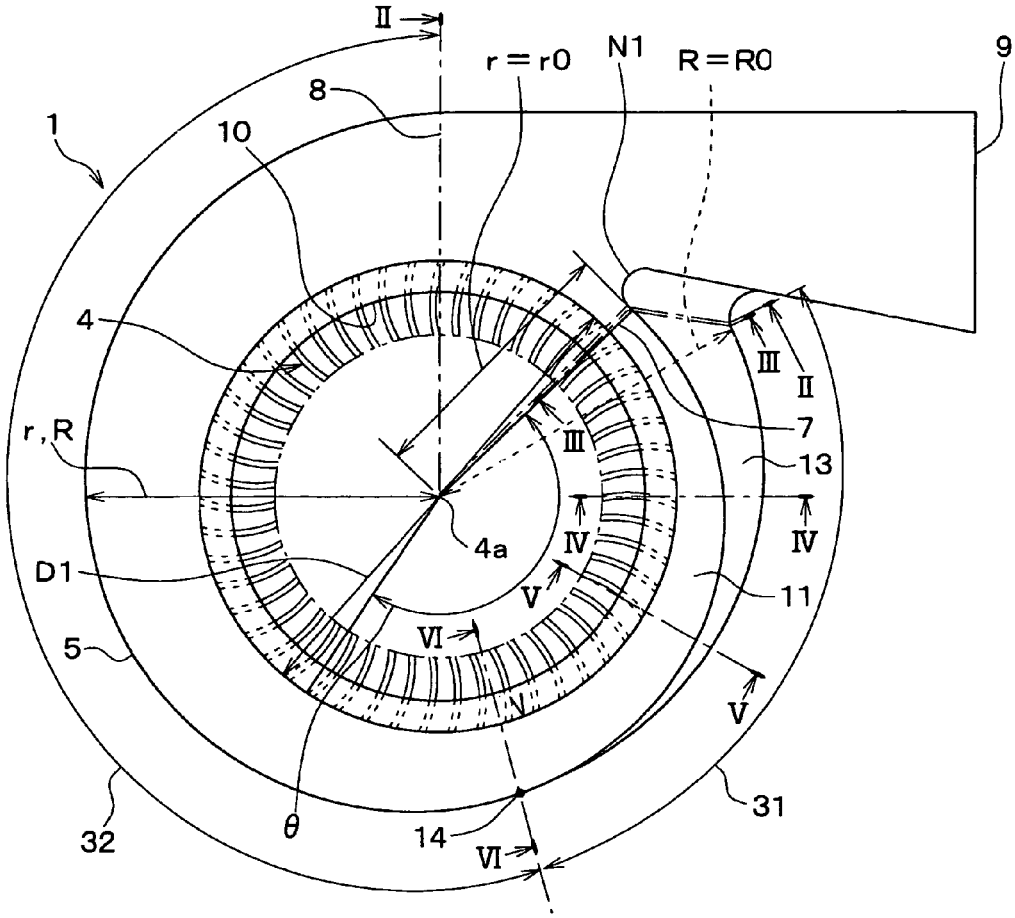
FIG. 1 is a plan view illustrating a blower according to a first embodiment of the invention.

An overall general constitution of a centrifugal type blower of a first embodiment of the invention is described below with reference to FIG. 1 and FIG. 2. FIG. 2 illustrates a cross section passing through a volute start part 7, a fan center 4*a* and a volute end part 8.

The centrifugal type blower 1 includes an electric motor 3 having a rotatable shaft 2, a fan 4 made of resin and driven by the electric motor 3 to rotate so as to blow out air, and a casing 5 made of resin and accommodating the fan 4.

The casing 5 includes an air passage 6 which gathers air blown out of the fan 4 radially outward of the fan 4. The air passage 6 is arranged from the volute start part 7 to the volute end part 8 of the casing 5 formed in an involuted manner, so as to introduce air to an air outlet 9 of the casing 5. The volute start part 7 is a starting portion of an arc-shaped side wall surface defining the air passage 6 at a nose part N1, and the volute end part 8 is an end portion of the arc-shaped side wall surface defining the air passage 6.

As shown in FIG. 2, the casing 5 has an inlet 10 which suctions air on its one end side in a direction of a rotatable shaft, and the electric motor 3 is attached on the other end side of the casing 5 in the rotatable shaft direction, i.e., on the opposite side of the casing 5 from the inlet 10.

The casing 5 includes an inlet side wall portion 11 on which side the inlet 10 is formed, a motor side wall portion 12 on the opposite side of the fan 4 from the inlet side wall portion 11, and a side wall part 13 radially outward of the fan 4 which defines the air passage 6 together with the fan 4 between the side wall part 13 and the fan 4. In FIG. 2, an upper end portion of the side wall part 13 is an inlet side end portion 13*a*, a lower end portion of the side wall part 13 is a counter-inlet side end portion 13*b*, and an intermediate position of the side wall part 13 from the inlet side end portion 13*a* to the counter-inlet side end portion 13*b* in its vertical direction is an intermediate position 13*c* of the side wall part 13 in its rotation axis direction. The casing 5 is divided between an inlet side portion 5*a* and a motor side portion 5*b*, and the inlet side portion 5*a* and the motor side portion 5*b* are coupled together at a joined portion 5*c* so as to constitute the casing 5.

The fan 4 is a centrifugal type multiblade fan 4, and includes plate-shaped blades 21 arranged around the rotatable shaft 2, an annular side shroud 22 connecting many blades 21 on one end side of the fan 4 in the rotation axis direction, and a main shroud 23 which connects many blades 21 and is joined to the rotatable shaft 2 on the other end side of the fan 4 in the rotation axis direction. The main shroud 23 is formed so as to cover the electric motor 3, and has, for example, a generally conic surface shape convexed on one end side of the fan 4 in the rotation axis direction, i.e., on the side shroud 22 side. The shape of the main shroud 23 may be modified into a circular flat surface shape.

The fan 4 is rotated by the electric motor 3 so as to suction air into the fan 4 through one end side of the fan 4 in the rotation axis direction. The fan 4 blows out the suctioned air radially outward of the fan 4.

Next, a specific constitution of the casing 5 is described below with reference to FIG. 3 to FIG. 6.

In the first embodiment, as shown in FIG. 1 and FIG. 3 to FIG. 6, a first distance r from the center 4*a* of the fan 4 to the side wall part 13 at the inlet side end portion 13*a* of the side wall part 13 in a radial direction of the fan 4 increases in a logarithmic spiral manner from the volute start part 7 to the volute end part 8 in a rotational direction of the fan 4. More specifically, the first distance r varies as expressed by the following equation.

$$r=r0\times\exp(\theta\times\tan(\alpha))$$

$\alpha$ may be in a range of 3 to 3.5, and r0 is a length of the first distance at the volute start part 7, for example, 0.57 times larger than an outer diameter D1 of the fan 4. $\theta$ is a volute angle, and is an angle of rotation from the volute start part 7 in the rotational direction of the fan 4 around the center 4*a* of the fan 4.

Figure 3:
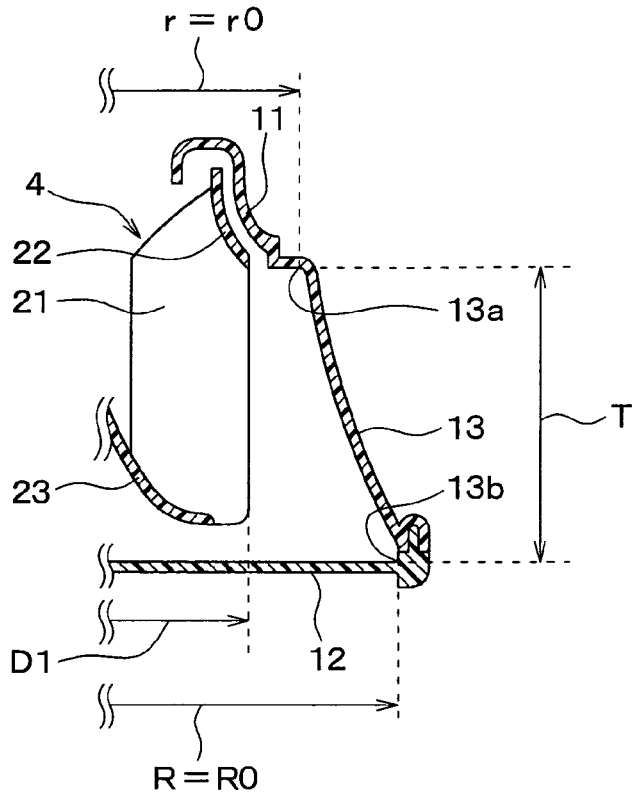
FIG. 3 is a sectional view taken along a line III-III in FIG. 1.
Figure 4:
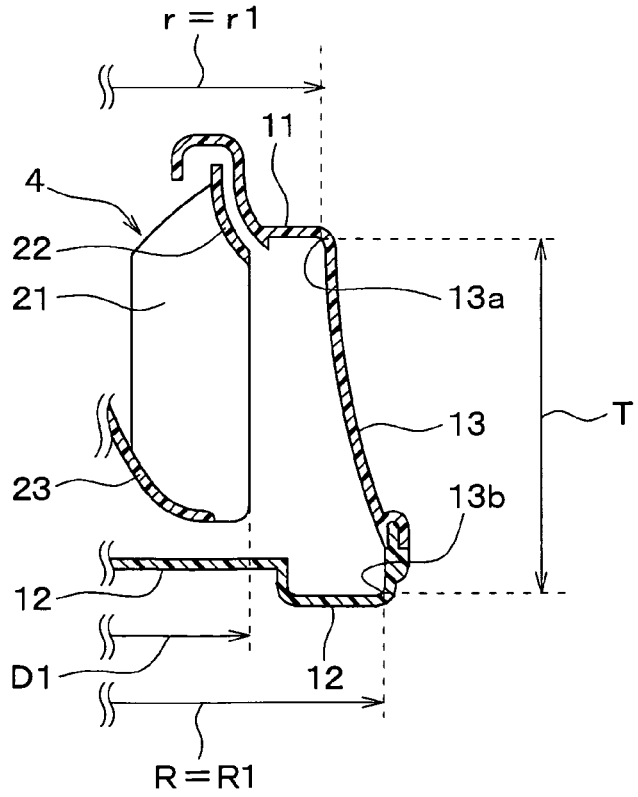
FIG. 4 is a sectional view taken along a line IV-IV in FIG. 1.
Figure 5:
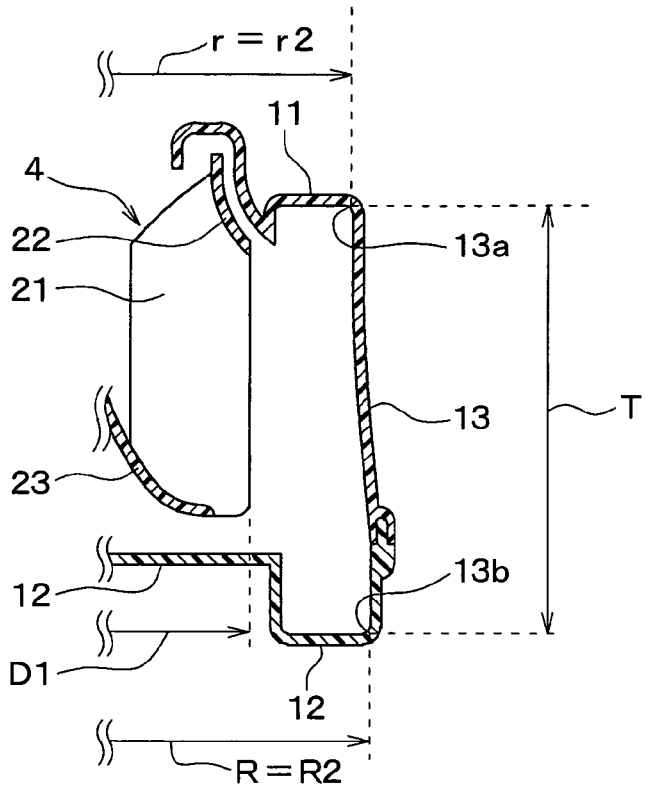
FIG. 5 is a sectional view taken along a line V-V in FIG. 1.
Figure 6:
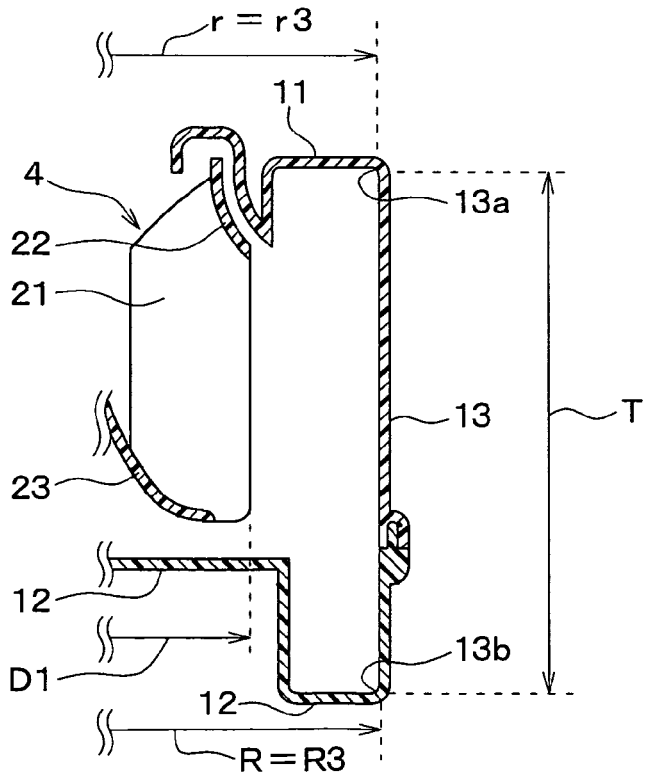
FIG. 6 is a sectional view taken along a line VI-VI in FIG. 1.

A second distance R from the center 4*a* of the fan 4 to the side wall part 13 at the counter-inlet side end portion 13*b* of the side wall part 13 in the radial direction of the fan 4 is, as shown in FIG. 3 to FIG. 5, larger than the first distance r in a first range 31 from the volute start part 7 to a predetermined position 14 of the air passage 6 except the predetermined position 14. As shown in FIG. 6, the second distance R has the same length as the first distance r in a second range 32 from the predetermined position 14 to the volute end part 8 of the air passage 6.

Given that the first and second distances in FIG. 4 are r1 and R1, the first and second distances in FIG. 5 are r2 and R2, and the first and second distances in FIG. 6 are r3 and R3, for example, relations of r0<R0, r1<R1, and r2<R2 are satisfied at positions of FIG. 3 to FIG. 5 which are in the first range 31, and a relation of r3=R3 is satisfied at a position of FIG. 6 within the second range 32.

The predetermined position 14 is a halfway position of the air passage 6 from the volute start part 7 to the volute end part 8, and may be a position near the opposite position from the volute end part 8 of the air passage 6, for example, a position in a range of 150 to 210 degrees from the volute end part 8 in a counter direction to the rotational direction of the fan 4.

A relation between the second distances R at positions of FIG. 3 to FIG. 6 is R0>R1>R2>R3, and the second distance R gradually decreases within the first range 31 from the volute start part 7 toward the predetermined position 14. The second distance R increases in a logarithmic spiral manner in the second range 32, maintaining the same length as the first distance r.

Accordingly, compared to a case where the second distance R is increased or maintained at a constant length from the volute start part 7 toward the predetermined position 14 within the first range 31 and where the second distance R is increased, being maintained at the same length as the first distance r, within the second range 32, the second distance at the volute start part is increased with the upsizing of the casing being limited. Therefore, a noise which is generated as a result of impingement of the air blown out of the fan against the nose part is further reduced.

As shown in FIG. 3 to FIG. 5, an inner wall of the side wall part 13 is formed in a convex shape inward of the casing 5, i.e., toward the air passage 6 side. More specifically, when viewed on a cross section parallel to the rotatable shaft 2, the side wall part 13 is formed so as to be recessed inward of a virtual straight line connecting the inlet side end portion 13*a* and the counter-inlet side end portion 13*b*, for example, in an arc shape. Accordingly, the air passage 6 is adjusted such that its passage sectional area increases in a logarithmic spiral manner in the entire range of the air passage 6 from the volute start part 7 to the volute end part 8. In addition, the shape of the side wall part 13 is not limited to an arc shape as long as its inner wall has a convex shape, and may be a crooked shape having an angle.

In the present embodiment, in order to change the passage sectional area of the air passage 6 in a logarithmic spiral manner, a ratio of the second distance R0 at the volute start part 7 to the outer diameter D1 of the fan 4 is in a range of 0.7 to 1.0. This is because it is difficult to change the passage sectional area of the air passage 6 in a logarithmic spiral manner if the ratio is larger than 1.0. On the other hand, the reason for the ratio being equal to or larger than 0.7 is that a ratio of R0 to the outer diameter of the fan is smaller than 0.7 in the above-described publication JP-A-2002-339899 since it is described in the paragraph [0023] of JP-A-2002-339899 (corresponding to [0046] of US2002/0131861A1) that a ratio of the second clearance dimension, which is a gap between the fan and the side wall part, to the outer diameter of the fan is in a range of 0.1 to 0.16, and that this ratio of R0 to the outer diameter of the fan is larger than 0.7 in the present embodiment.

In the first embodiment, as shown in FIG. 2 to FIG. 6, a distance T between the inlet side wall portion 11 and the counter-inlet side wall portion 12, which constitute the air passage 6, in a direction parallel to the rotatable shaft 2, increases gradually from the volute start part 7 toward the volute end part 8.

The inlet side wall portion 11 moves to the inlet side in the direction of the rotatable shaft 2, and as shown in FIG. 2, a ratio of a moving width ΔT1 from the volute start part 7 to the volute end part 8 to a fan height 24 is in a range of 0.25 to 0.58. Likewise, the counter-inlet side wall portion 12 also moves to the counter-inlet side in the direction of the rotatable shaft 2, and as shown in FIG. 2, a ratio of a moving width ΔT2 from the volute start part 7 to the volute end part 8 to a fan height 24 is in a range of 0.25 to 0.58.

Figure 2:
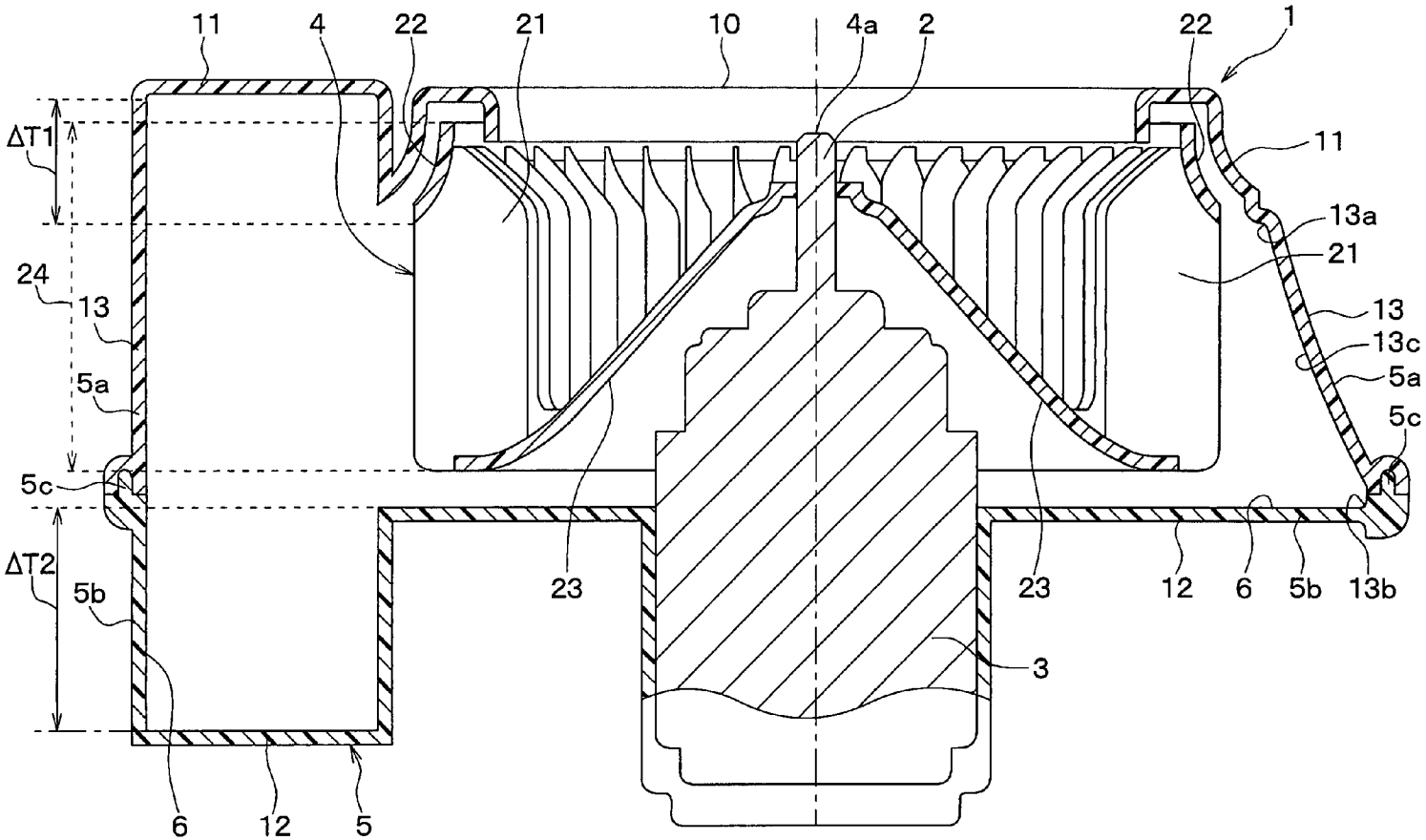
FIG. 2 is a sectional view taken along a line II-II in FIG. 1.
Figure 12:
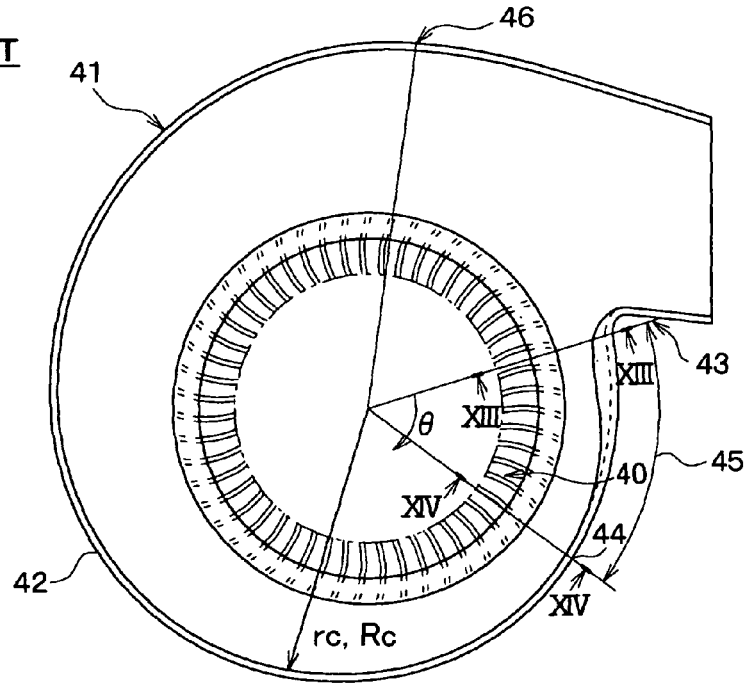
FIG. 12 RELATED ART
FIG. 12 is a plan view illustrating a blower according to a comparative example.
Figure 13:
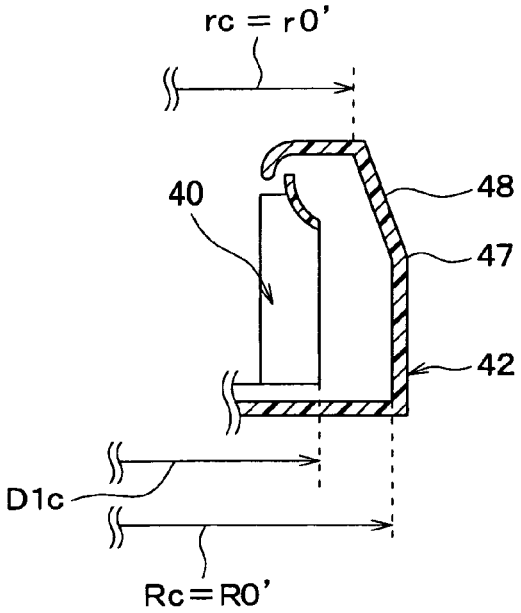
FIG. 13 RELATED ART
FIG. 13 is a sectional view taken along a line XIII-XIII in FIG. 12.
Figure 14:
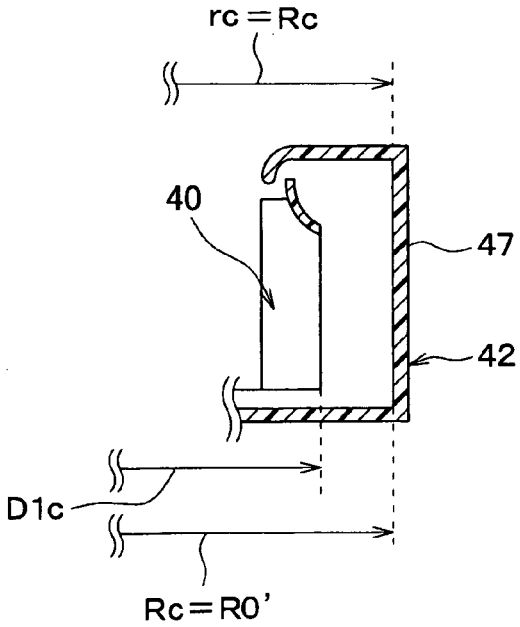
FIG. 14 RELATED ART
FIG. 14 is a sectional view taken along a line XIV-XIV in FIG. 12.

As shown in FIG. 12 to FIG. 14, a blower 41 of a comparative example is different from the blower 1 of the first embodiment in FIG. 1 in that a second distance Rc of the casing 42 is constant, maintaining a second distance R0' at the volute start part 43, within a predetermined range 45 from a volute start part 43 of a casing 42 to a predetermined volute angled position 44. In addition, on a volute end part 46 side of the predetermined range 45 in a rotational direction of a fan 40, the second distance Rc increases in a logarithmic spiral manner toward the volute end part 46.

Furthermore, as shown in FIG. 13, the blower 41 of the comparative example is different from the blower 1 of the present embodiment in that an inlet side portion 48 of a side wall part 47 of the casing 42 is inclined toward the fan 40 within the predetermined range 45 and accordingly the side wall part 47 is formed in a convex shape outward of the casing 42. The other constitution in the comparative example is similar to the first embodiment.

The blower 1 of the present embodiment is compared with the blower 41 of the comparative example. In the comparative example, the second distance Rc is constant (R0) from the volute start part 43 to the predetermined volute angled position 44, and the second distance Rc increases in a logarithmic spiral manner from the predetermined volute angled position 44 toward the volute end part 46. In the present embodiment, on the other hand, after the second distance R gradually decreases from R0 from the volute start part 7 to the predetermined position 14, the second distance R increases in a logarithmic spiral manner from the predetermined position 14 toward the volute end part 8.

Accordingly, provided that the second distance R0 at the volute start part 7 of the first embodiment and the second distance R0' at the volute start part 43 of the comparative example are the same, in the blower 1 of the present embodiment, the second distance R decreases from R0 from the volute start part 7 to the predetermined position 14, so that a size of the casing 5 is made smaller than the blower 41 of the comparative example.

In other words, according to the present embodiment, provided that the size of the casing 5 is the same as a size of the casing 42 of the blower 41 of the comparative example, the second distance R0 at the volute start part 7 is made larger than the blower 41 of the comparative example. Therefore, according to the present embodiment, upsizing of the casing 5 is alleviated, and the second distance R0 at the volute start part 7 is made large in comparison to the comparative example. Consequently, a noise which is generated as a result of impingement of the air blown out of the fan 4 against the nose part N1 is further reduced.

In the comparative example, the first distance rc increases in a logarithmic spiral manner, and the second distance Rc is maintained at R0', which is larger than the first distance rc, within the predetermined range 45 from the volute start part 43 to the predetermined position 44. The side wall part 47 is formed in a convex shape outward of the casing 42.

Figure 7:
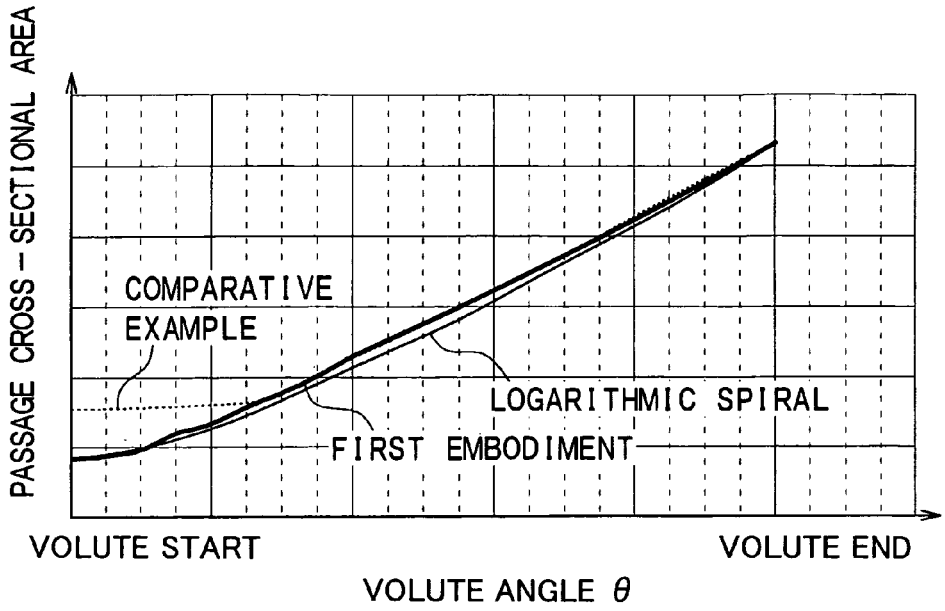
FIG. 7 is a graph illustrating a changing state of a cross-sectional area of an air passage according to the first embodiment and the comparative example.
Figure 8:
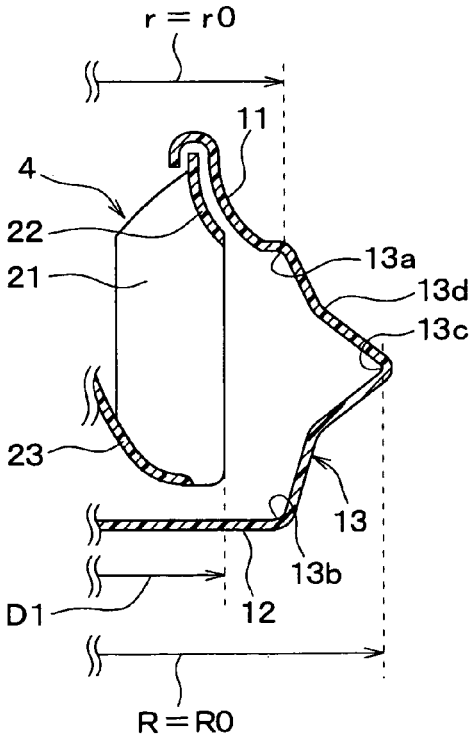
FIG. 8 is a partial sectional view illustrating a blower according to a second embodiment of the invention.
Figure 9:
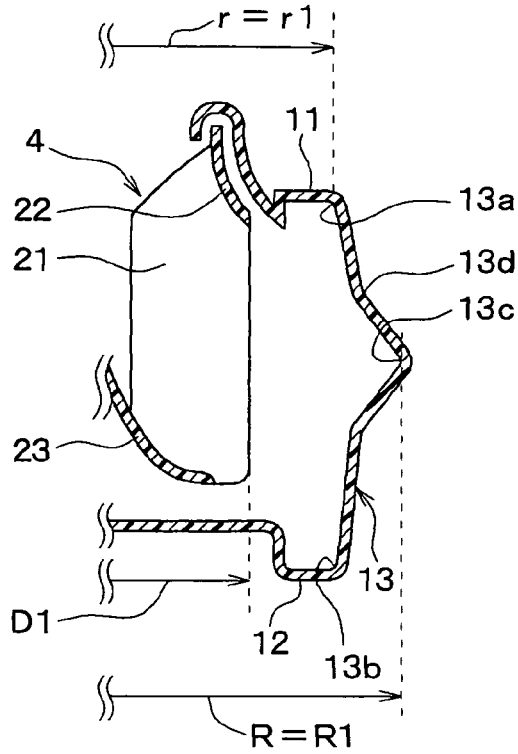
FIG. 9 is a partial sectional view illustrating the blower according to the second embodiment.
Figure 10:
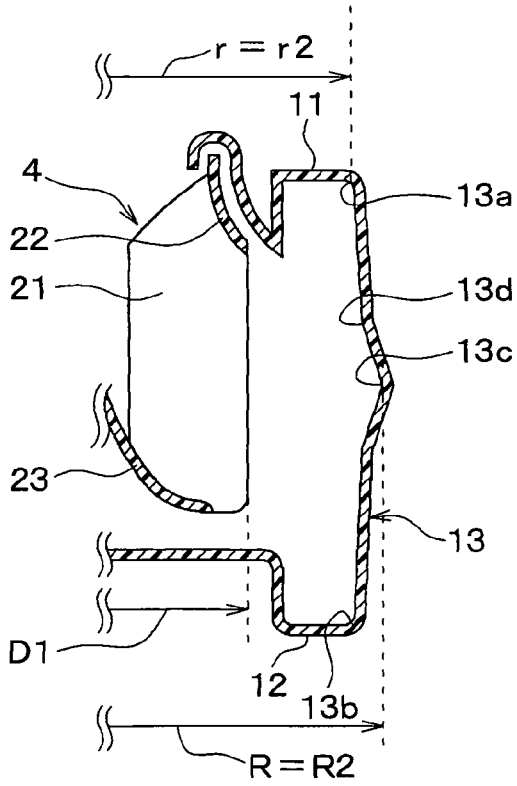
FIG. 10 is a partial sectional view illustrating the blower according to the second embodiment.
Figure 11:
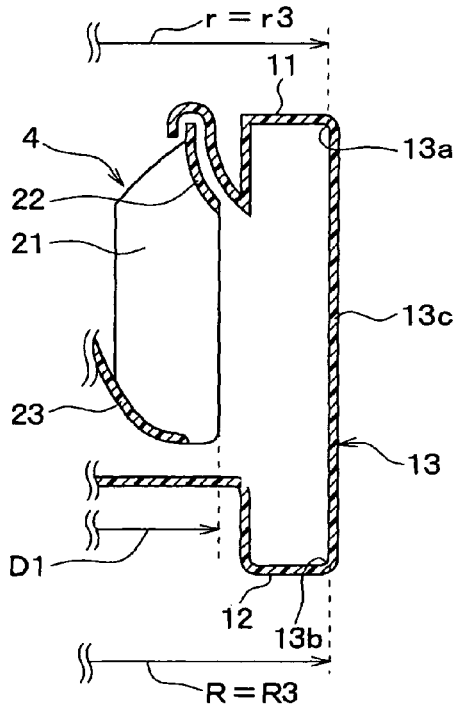
FIG. 11 is a partial sectional view illustrating the blower according to the second embodiment.

For this reason, as shown in FIG. 7, in the comparative example, the cross-sectional area of the air passage is larger than its logarithmic spiral increase from the volute start part to the predetermined position, and the cross-sectional area changes rapidly on reaching the predetermined position.

In this case, when air flows through the air passage from the volute start part 43 toward the volute end part 46, resistance becomes large halfway therebetween. Because of this, air flowing through the air passage easily flows backwards, thereby generating a noise. In an air conditioning system for a vehicle, in particular, in its foot mode or in its defroster mode, resistance to airflow is greater than in its face mode, and in the case of such high pressure loss, the noise due to the backflow becomes prominent.

In the present embodiment, by forming the inner wall of the side wall part 13 in the first range 31 in a convex shape projecting inward of the casing 5, the passage sectional area of the air passage 6 is adjusted so as to increase logarithmic-spirally in the entire range of the air passage 6 from the volute start part 7 to the volute end part 8. Hence, according to the first embodiment in comparison to the comparative example, a problem of the noise due to the backflow of air in the case of high pressure loss is resolved.

By changing a cross-sectional area of the air passage in a logarithmic spiral manner in this manner, performance deterioration of the blower due to the sudden change of the cross-sectional area of the air passage is restrained.

Second Embodiment

FIG. 8 to FIG. 11 correspond to FIG. 3 to FIG. 6, respectively, and the same numerals as FIG. 3 to FIG. 6 are used in FIG. 8 to FIG. 11 for indicating the same components as those in FIG. 3 to FIG. 6. Differences from the first embodiment are described below.

In the second embodiment, a position of a casing 5 whereby a distance from a center 4*a* of a fan 4 to a side wall part 13 is maximized is not a counter-inlet side end portion 13*b* of the side wall part 13, but an intermediate position 13*c* of the side wall part 13 in a rotation axis direction. The distance from a center 4*a* of a fan 4 to a side wall part 13 at the intermediate position 13*c* is a second distance R.

In the present embodiment as well, the casing 5 is formed such that an inner wall of the side wall part 13 from an inlet side end portion 13*a* to the intermediate position 13*c*, whose distance to the center 4*a* is a second distance R, within a first range 31, is crooked so as to have a vertex 13*d* ahd has a convex shape projecting inward of the casing 5. Accordingly, the passage sectional area of the air passage 6 is adjusted so as to increase logarithmic-spirally in the entire range of the air passage 6 from the volute start part 7 to the volute end part 8. In addition, the inner wall of the side wall part 13 may have an arc shape in its section, as in the first embodiment.

Other Embodiments (1) In the first embodiment, a distance between the center 4*a* and the side wall part 13 is the second distance R at the counter-inlet side end portion 13*b* of the side wall part 13, and in the second embodiment, a distance between the center 4*a* and the side wall part 13 is the second distance R at the intermediate position 13*c* of the side wall part 13 in its rotation axis direction. Alternatively, a position where the distance between the center 4*a* and the side wall part 13 is the second distance R may be any position of the side wall part 13 from the intermediate position 13*c* to the counter-inlet side end portion 13*b* in the rotation axis direction. Because the wind blown out of the fan 4 flows toward the counter-inlet side, the noise which is generated as a result of impingement of the air blown out of the fan 4 against the nose part N1 is reduced by making large the distance from the center 4*a* of the fan 4 to the side wall part 13 at such a position.

(2) In the above-described embodiments, the distance T between the inlet side wall portion 11 and the counter-inlet side wall portion 12, which constitute the air passage 6, in a direction parallel to the rotatable shaft 2, increases gradually from the volute start part 7 to the volute end part 8. Alternatively, the distance T may be constant without varying in the entire range.

(3) In each of the above embodiments, the invention is applied to a blower in an air conditioning system for a vehicle. Alternatively, the invention may be applied to a blower for other purposes. The above-described embodiments may be combined together arbitrarily in a practicable range.

Additional advantages and modifications will readily occur to those skilled in the art. The invention in its broader terms is therefore not limited to the specific details, representative apparatus, and illustrative examples shown and described.

What is claimed is:

1. A centrifugal-type blower comprising:

a rotatable shaft;

a centrifugal-type multiblade fan having a plurality of blades around the rotatable shaft; and a casing having an involuted shape and accommodating the fan, the casing including:

a volute start part and a volute end part of the involuted shape;

an inlet for air on one end side of the casing in an axial direction of the rotatable shaft;

an air passage on an outer circumferential side of the fan; and a side wall part radially outward of the fan, wherein:

the side wall part, the fan, the volute start part, and the volute end part define the air passage;

the side wall part includes an inlet side end portion on a side of the inlet, a counter-inlet side end portion on an opposite side from the inlet, and an intermediate position between the inlet side end portion and the counter-inlet side end portion in the axial direction of the rotatable shaft;

a first distance from a center of the fan to the side wall part at the inlet side end portion thereof in a radial direction of the fan gradually increases from the volute start part to the volute end part in a rotational direction of the fan;

a second distance from the center to the side wall part at any position thereof from the intermediate position to the counter-inlet side end portion in the radial direction of the fan is larger than the first distance within a first range from the volute start part to a predetermined position, which is located halfway from the volute start part to the volute end part, in the rotational direction of the fan except the predetermined position;

the second distance gradually decreases from the volute start part to the predetermined position; and the second distance has a same length as the first distance within a second range from the predetermined position to the volute end part in the rotational direction of the fan.

2. The centrifugal-type blower according to claim 1, wherein:

the first distance increases in a logarithmic-spiral manner from the volute start part to the volute end part; and an inner wall of the side wall part from the inlet side end portion to a position of the side wall part, at which a distance from the center to the side wall part in the radial direction of the fan is the second distance, has a convex shape projecting inward of the casing, so that a cross-sectional area of the air passage increases in a logarithmic-spiral manner in an entire range from the volute start part to the volute end part.

3. The centrifugal-type blower according to claim 2, wherein:

the casing further includes an inlet side wall portion on the side of the inlet and a counter-inlet side wall portion on the opposite side from the inlet;

the inlet side wall portion and the counter-inlet side wall portion define the air passage together with the side wall part, the fan, the volute start part, and the volute end part; and a distance between the inlet side wall portion and the counter-inlet side wall portion in a direction parallel to the rotatable shaft gradually increases from the volute start part to the volute end part.

4. The centrifugal-type blower according to claim 1, wherein given that R0 is the second distance at the volute start part and D1 is an outer diameter of the fan, a ratio of R0 to D1 is in a range of 0.7 to 1.0.

5. The centrifugal-type blower according to claim 1, wherein the predetermined position is positioned in a range of 150° to 210° from the volute end part in a counter direction to the rotational direction of the fan with respect to the center of the fan.

* * * * *